US006758154B2

(12) United States Patent
Johnston

(10) Patent No.: US 6,758,154 B2
(45) Date of Patent: Jul. 6, 2004

(54) TUFTING MACHINE

(76) Inventor: Kendall Johnston, 460 N. Milford St., Orange, CA (US) 92867

( * ) Notice: Subject to any disclaimer, the term of this patent is extended or adjusted under 35 U.S.C. 154(b) by 89 days.

(21) Appl. No.: 10/190,777

(22) Filed: Jul. 5, 2002

(65) Prior Publication Data

US 2004/0003764 A1 Jan. 8, 2004

(51) Int. Cl.[7] ..... D05C 15/18
(52) U.S. Cl. ..... 112/80.73
(58) Field of Search ..... 112/80.01, 80.73, 112/100, 80.7, 220

(56) References Cited

U.S. PATENT DOCUMENTS

| | | | | |
|---|---|---|---|---|
| 2,213,552 A | | 9/1940 | Scharr | |
| 3,103,903 A | | 9/1963 | Broadrick et al. | |
| 3,375,797 A | | 4/1968 | Gaines | |
| 3,489,326 A | | 1/1970 | Singleton | |
| 3,709,173 A | | 1/1973 | Greene | |
| 3,835,797 A | * | 9/1974 | Franks et al. | 112/80.73 |
| 3,847,098 A | | 11/1974 | Hammel, Jr. | |
| 3,926,132 A | | 12/1975 | Lear et al. | |
| 4,134,348 A | | 1/1979 | Scott | |
| 4,382,704 A | | 5/1983 | Hendrischk | |
| 4,532,667 A | | 8/1985 | Komesker et al. | |
| 4,608,935 A | | 9/1986 | Bardsley | |
| 4,822,241 A | * | 4/1989 | Jarvis et al. | 415/132 |
| 4,856,441 A | | 8/1989 | Kurata | |
| 4,864,946 A | | 9/1989 | Watkins | |
| 5,182,997 A | | 2/1993 | Bardsley | |
| 5,743,201 A | | 4/1998 | Card et al. | |
| 5,899,152 A | * | 5/1999 | Bardsley et al. | 112/80.73 |
| 6,009,818 A | | 1/2000 | Card et al. | |
| 6,105,522 A | * | 8/2000 | Kato | 112/220 |

OTHER PUBLICATIONS

Cobble Spare Parts Manual: Full Repeat Scroll (Issue 2).

* cited by examiner

*Primary Examiner*—Ismael Izaguirre
(74) *Attorney, Agent, or Firm*—Knobbe, Martens, Olson & Bear, LLP

(57) ABSTRACT

A tufting machine includes a feed roller assembly formed of a plurality of coaxially aligned and detachable shaft members.

16 Claims, 6 Drawing Sheets

TUFTING MACHINE

BACKGROUND OF THE INVENTION

1. Field of the Invention

The present invention is directed to a tufting machine, and more particularly, an improved feed roller assembly for a tufting machine.

2. Description of the Related Art

Tufting machines are widely used for manufacturing tufted pile fabrics, such as carpeting. Many tufting machines include yarn feed roller pattern attachments or assemblies configured to produce variations in pile height of the carpet products.

Yarn feed roller assemblies typically include groups of yarn feed rollers which are driven at different speeds. The rollers in each group are arranged parallel to each other and are closely spaced. An array of strands of yarn are guided across each group of rollers.

Pattern attachments known as "full repeat scrolls" include an array of yarn wheels rotatably mounted adjacent to each roller. One yarn wheel is provided for each strand of yarn guided across each roller. The yarn wheels are movable in and out of engagement with the yarn. In the engaged position, the yarn wheel presses the yarn against the roller. Thus, because the yarn roller is driven, the yarn roller pulls the yarn into the tufting machine.

The yarn wheels can be independently driven. Additionally, the yarn rollers can be driven at different speeds. Thus, by driving the yarn wheels into and out of engagement with different rollers, adjacent strands of yarns can be fed at different rates. Additionally, the feed rate of a single strand of yarn can be changed quickly. Different feeding rates result in different pile heights in the resulting carpet product.

Examples of such machines are sold under the trademark Cobble™. These machines can be configured to provide two or three different pile heights in a carpet. Additionally, these machines can be configured to produce rolls of carpet approximately 13 feet wide. In such machines, the yarn rollers are made from metal shafts approximately four meters long.

In order to prevent bending and vibration of the feed rollers during operation, the scroll attachments are divided into a number of parallel yarn feeding bays. In one example, the bays are approximately 24 inches wide and are separated by bearing supports. Thus, each shaft is supported by 8 bearing supports. The bearing supports include recesses for receiving roller bearings which are mounted to each shaft in an known manner.

The shafts are made out of a strong metal material such as steel. The outer surface of the rollers, however, is covered with a softer material which provides a desired friction against the strands of yarn so as to transfer the rotational movement of the shaft to a linear displacement of the yarn strands. One type of covering that is commonly used is known as "Northrop Type LHP."

As a result of prolonged operation, the outer covering of the rollers can become worn or damaged. For example, the covering can be damaged to the point where the covering loses the ability to provide traction against the yarn. Thus, the yarn disposed in contact with that portion of the covering will not be fed properly. The resulting carpet product will have a visible flaw.

In order to allow the covering to be replaced, the covering can be procured in a roll having a narrow width, such as, for example, 2 inches wide. After the original covering has been removed, replacement covering can be re-applied by rotating the feed roller and wrapping the covering in a helical pattern around the outer surface of the roller.

This manner of replacing the outer surface of the roller allows the roller to remain installed on the tufting machine without having to remove the numerous strands of yarn from the machine. However, this process of resurfacing the feed rollers produces a length of carpet product that is unacceptable for resale. Thus, the roll of carpet being produced at that time must be cut so as to remove the unacceptable portion. Further, the roll of carpet being manufactured will not be of a standard length and thus would be resold as a remnant, or "odd size" and thus is usually sold for less than full price.

Another common repair performed on tufting machines, and in particular, full repeat scroll attachments, is related to the yarn wheels. As noted above, the yarn wheels are driven into and out of engagement with the feed rollers. Occasionally, a bearing which rotatably journals the yarn wheel fails. This failure results in an improper feeding speed of a particular strand of yarn. When a yarn wheel bearing fails, the feed rollers have to be dislodged so that the yarn wheels can be removed. In certain full repeat scroll attachments, the bearing support assemblies for the feed rollers are hingedly mounted to a frame. Thus, the feed rollers can be dislodged by removing two bolts from each bearing support assembly so that the bearing support assemblies can be pivoted about their respective hinges. For a machine with seven bays, 16 bolts have to be removed before the feed rollers can be pivoted, i.e., two bolts for each bearing support assembly.

Another common component to fail on tufting machines is the feed roller bearings. Known feed rollers are formed from a single steel shaft having a number of bearings press fit thereon. Additionally, as noted above, the portions of the shaft between the bearings are covered with a soft outer covering to provide friction against the yarn. Thus, when one of the bearings fails, the entire shaft must be removed, as well as the outer covering of the shaft, so that the damaged bearing can be removed. If the damaged bearing is near the center of the shaft, adjacent bearings also must be removed so that the damaged bearing can be removed.

SUMMARY OF THE INVENTION

One aspect of the present invention includes the realization that certain repairs to known full repeat scroll attachments can be made more quickly if portions of the feed roller can be removed or dislodged independently without the need to remove or dislodge the entire feed roller.

Another aspect of the present invention includes the realization that several of the drawbacks the of prior art spiral-wound yarn roller coverings can be overcome by using a vulcanized covering. For example, when the prior art helical covering is applied to a yarn roller, the covering should be applied so that adjacent edges of the windings are as close as possible. However, when this type of covering is applied during maintenance of a used tufting machine, the covering is applied by hand, while the shaft is in place with two arrays of yarn strands extending in front of and behind the shaft. Thus, at least slight imperfections in the spacing of the windings of the covering are inevitable. A vulcanized covering, however, provides substantially seamless outer surface, and thus, does not suffer from the problems caused by the presence of a helical seam on the outer surface of the roller.

In accordance with yet another aspect of the present invention, a tufting machine comprises a frame assembly, and a plurality of parallel yarn feeding bays supported by the frame. An inlet yarn guide is supported by the frame and is configured to guide a plurality of yarn strands into each of the bays. A needle assembly is supported by the frame and is configured to reciprocate relative to the frame. An outlet yarn guide is configured to guide the yarn strands from the bays into the needle assembly. The tufting machine also includes first and second feed roller assemblies, each extending across all of the bays. At least first and second bearing assemblies support both of the first and second feed roller assemblies. Each of the first and second bearing assemblies are disposed between two of the bays. First and second drives are configured to drive the first and second feed roller assemblies, respectively, such that the first feed roller assembly is driven at a speed greater than a speed of the second feed roller assembly. First and second wheels mounted adjacent the first and second feed roller assemblies, respectively, and are moveable between first and second configurations. In the first configuration, the first wheel presses a first yarn strand against the first feed roller. In the second configuration, the second wheel presses the first yarn strand against the second feed roller. Each roller assembly comprises at least first and second coaxially aligned cylindrical members, each having a terminal end disposed in the vicinity of one of the bearing assemblies which are disposed between two bays.

In accordance with a further aspect of the present invention, a tufting machine comprises at least two parallel yarn feeding bays. At least one bearing support assembly is disposed between the bays. At least one feed roller assembly extends across the bays. A plurality of wheels are moveable into and out of engagement with the feed roller assembly. The feed roller assembly comprises a plurality of co-axially aligned rollers being separable at a position in the vicinity of the bearing support assembly.

In accordance with yet another aspect of the present invention, a tufting machine comprises at least first, second, and third parallel yarn feeding bays. The second bay is between the first and second bays. At least one roller assembly extends across all three bays. At least one wheel is moveable into and out of engagement with the roller assembly. The feed roller assembly comprising first, second, and third feed rollers aligned with the first, second, and third bays, respectively. Additionally, the machine includes means for allowing the second roller to be removed without removing the first and third rollers.

In accordance with another aspect of the present invention, a tufting machine comprises a plurality of parallel yarn feeding bays. At least one roller assembly extends across all three bays, the feed roller assembly comprises a vulcanized outer covering.

BRIEF DESCRIPTION OF THE DRAWINGS

These and other features, aspects, and advantages of the present invention will now be described with reference to the drawings of preferred embodiments which are intended to illustrate and not to limit the invention. The drawings comprise the following figures.

DETAILED DESCRIPTION OF THE PREFERRED EMBODIMENT

Figure 1:
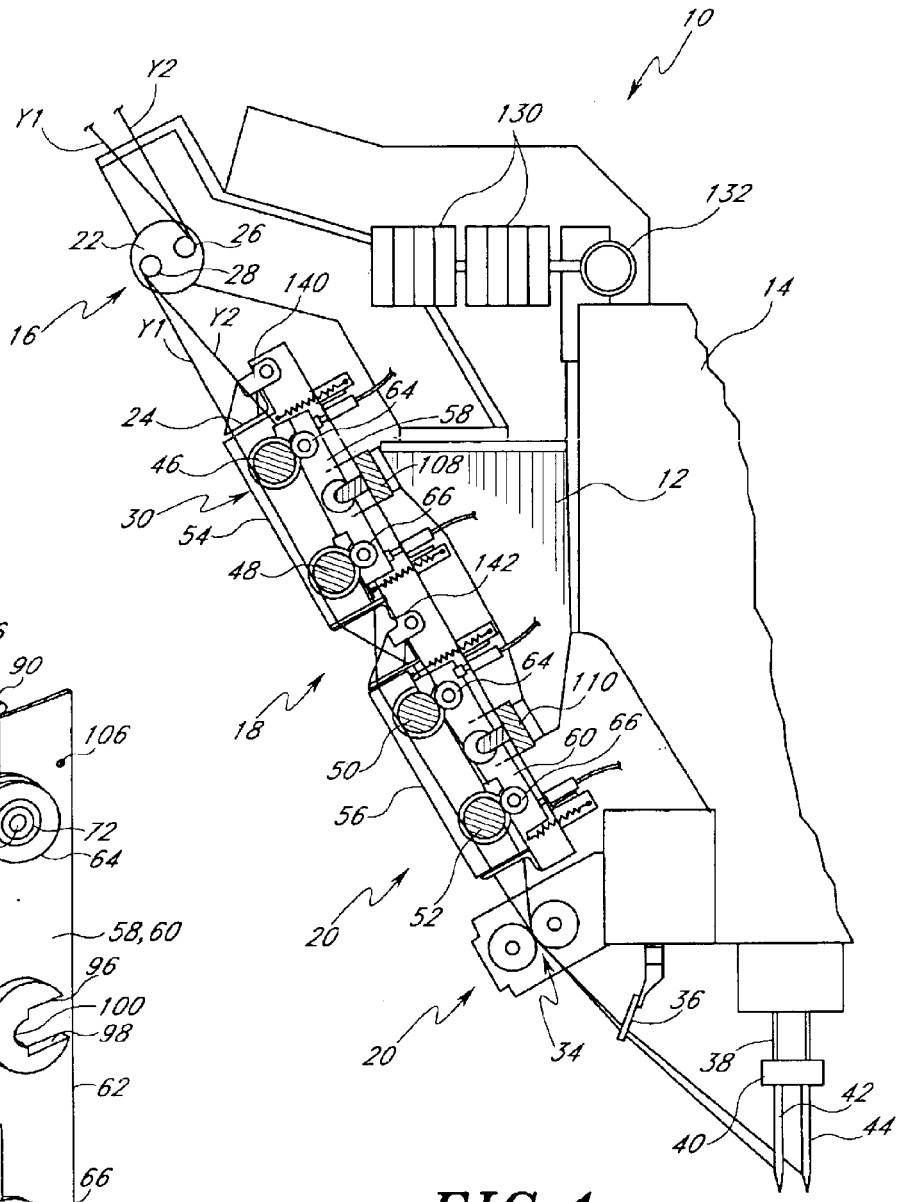
FIG. 1 (PRIOR ART)
FIG. 1 is a partial sectional and side elevational view of a known tufting machine with a full repeat scroll attachment having two pairs of yarn feed rollers and corresponding sets of yarn wheel pitman arms.

With reference to FIGS. 1–4 an overall configuration of a known tufting machine 10 is described to assist the readers understanding of a preferred environment of use of the present invention. The tufting machine 10 is described in reference to a coordinate system wherein a longitudinal dimension of the machine 10 extends in a direction generally horizontally and transversely to the direction through which yarn is fed through the machine 10. In addition, relative heights are expressed as elevations in reference to the undersurface of the machine 10.

Generally, the machine 10 includes a frame assembly 12, a needle head assembly 14, a yarn inlet 16, a yarn feed assembly 18, and a yarn outlet assembly 20. In the illustrated machine 10, the inlet 16, yarn feed assembly 18, and the outlet 20 define a scroll attachment of the tufting machine 10. The head 14, inlet 16, feed assembly 18, and the outlet 20 are supported by the frame 12.

The frame 12 includes a number of load bearing members, brackets, and legs for supporting the head 14, inlet 16, feed roller assembly 18, and outlet 20.

The inlet 16, feed assembly 18, and outlet 20 are configured to guide a plurality of yarn strands from the yarn supply (not shown) to the lower end of the needle head 14. The yarn strands Y1, Y2, illustrated in FIG. 1, each represent an array of yarn strands fed from the yarn supply. The arrays of yarn strands Y1, Y2 are interlaced so as to alternate along the longitudinal length of the machine 10, as known in the art.

The inlet 16 includes a tensioner 22 and a strand guide 24. The tensioner 22 includes a pair of guide rods 26, 28 that can be rotated relative to each other to adjust the tension in the yarn strands Y1, Y2. The yarn guide 24 separates the yarn strands Y1 from the yarn strands Y2.

The feed assembly 18 includes a first drive roller assembly 30 and a second drive roller assembly 32. The first drive roller assembly 30 is configured to control the feeding of yarn strand Y2. The second feed roller assembly 32 is configured to control the feeding of yarn strand Y1.

The outlet 20 includes a nip roller assembly 34 and a jerker 36. The construction and operation of the nip roller 34 and the jerker 36 are known in the art and are not described further.

The needle head 14 includes the plurality of spaced push rods 38 which are reciprocally mounted within the head 14. A needle bar 40 is mounted at the lower ends of the push rod 38.

The needle bar 14 supports at least one row of needles. In the illustrated embodiment, the needle bar supports two rows of needles 42, 44. The needles 42, 44 reciprocate, up and down, along with the push rods and needle bar 40. The yarn strands Y1, Y2 are arranged in the machine 10 such that the upper feed roller assembly 30 controls the feed of yarn strand Y1 to the needles 42 and the lower feed roller assembly 32 controls the feed rate of the yarn strands Y2 to the needle 44. The needles 42, 44 cooperate in a conventional manner with loopers and hooks (not shown) mounted beneath the head in a manner well known in the art.

Each of the roller assemblies 30, 32 include a pair of feed rollers. In particular, the upper feed roller assembly 30 includes an upper roller 46 and a lower roller 48. The lower feed roller assembly 32 includes an upper roller 50 and a lower roller 52. All of the rollers 46, 48, 50, 52 are made from single shafts which extend along the longitudinal length of the machine 10.

Each of the roller assemblies 30, 32 include a plurality of bearing support assemblies 54, 56. In one known machine 10, the shafts 46, 48, 50, 52 are approximately four meters long. The bearing supports 54, 56 are spaced along the longitudinal length of the shafts, 46, 48, 50, 52. In a machine in which the shafts 46, 48, 50, 52 are four meters long, eight bearing support assemblies 54 are arranged along the longitudinal length of the shafts 46, 48. The same number of bearing support assemblies 56 support the shafts 50, 52.

The bearing support assemblies 54, 56 are spaced approximately 24 inches apart. Thus, the bearing support assemblies 54, 56 define seven yarn feeding bays along the longitudinal length of the shafts 46, 48, 50, 52.

The machine 10 also includes a feed roller drive system for driving the rollers 46, 48, 50, 52. In one known machine, the rollers 46, 50 are driven at a speed lower the speed at which the rollers 48, 52 are driven. As such, each of the feed roller assemblies 30, 32 can feed a yarn strand at either the lower speed corresponding to the rotational speed of the shafts 46, 50, or at the higher speed corresponding to the rotational speed of the shafts 48, 52.

In order to engage a yarn strand with either the low speed or high speed roller, each of the feed roller assemblies 30, 32 include a plurality of control arms 58, 60, respectively. Since each arm and its associated feed rollers are substantially identical and operate in the same manner, only one such arm, i.e., the control arm 60 is described in greater detail below, with reference to FIGS. 2–4.

Figure 2:
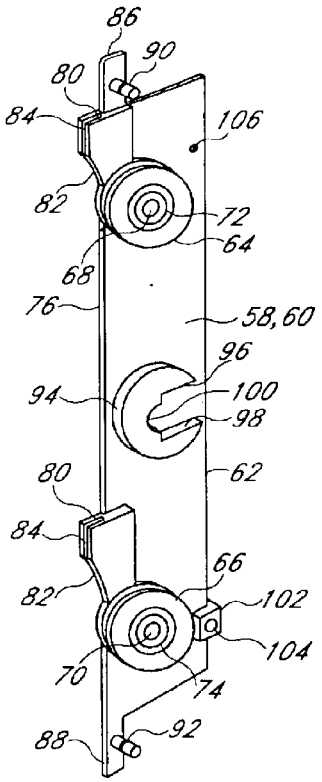
FIG. 2 (PRIOR ART)
FIG. 2 is an enlarged perspective view of one of the pitman arms shown in FIG. 1.

With reference to FIG. 2, each control arm 58, 60 comprises a substantially flat rectangular plate 62. Preferably, the plate is constructed from a metal such as aluminum, however other metals or plastic can be used. Each control arm 58, 60 also includes a pair of yarn wheels 64, 66. The yarn wheels 64, 66 are rotatably mounted to shafts 68, 70, respectively. The shafts 68, 70 are mounted to the plate 62. Preferably, the yarn wheels 64, 66 include bearings 72, 74, respectfully, which journal the wheels 64, 66 for rotation relative to the shafts 68, 70.

With reference to FIG. 2, each of the wheels 64, 66 are mounted such that a periphery of the wheels 645, 66 project beyond an elongated edge 76 of the plate 62. The projection of the wheels 64, 66 allows these wheels to engage the rollers 46, 48, 50, 52, described in greater detail below. Adjacent to each wheel 64, 66 and slightly upstream in the direction of travel of a yarn strand, guide plates 80 are mounted along the edge 76 of the plate 62.

Each guide member generally has a rectangular configuration. However, at the edge adjacent to the wheels 64, 66, each guide member 80 has a concave portion 82. The contour of the concave portions 82 are complimentary to the outer surface of the feed rollers 46, 48, 50, 52.

The guides 80 are mounted such that a clearance space is provided between the feed rollers 46, 48, 50, 52 and the portions 82. A guide slot 84 is formed in each of the guide members 80. During operation, a yarn strand Y1, Y2 passes through the guide slot 84 so that the yarn strand remains aligned with the yarn wheels 64, 66. Fingers 86, 88 are formed at the upper and lower ends of the plate 62, respectively. Pins 90, 92 are mounted to the fingers 86, 88, respectively.

A journal member 94 is disposed at approximately the center of the plate 62. The journal member 94 preferably is formed from a bearing material such as brass for forming a pivot journal for the arm 58, 60. The journal member 94 defines a female member having a substantially c-shaped configuration. The limbs of the c-shaped configuration define vertically spaced apart surfaces 96, 98. Additionally, a concave surface 100 is formed between the surfaces 96, 98.

The arms 58, 60 also include an abutment member 102. The abutment member 102 is spaced from the journal member 94, such that a pivoting force can be applied to the plate 62, described in greater detail below. On alternate arms 58, 60 across the machine 10, the abutment members 102 are adjacent to and slightly below the yarn wheel 66. On the other arms, the members 102 are adjacent to and above the yarn wheel 64. Preferably, the abutment members 102 are attached to the arms 50, 60 by a rivet 104. With reference to the upper portion of FIG. 2, a hole 106 is provided for receiving the rivet 104. With reference to FIG. 1, pivot rails 108, 110 are mounted to the frame 12 and extend longitudinally along the feed roller assemblies 30, 32, respectively.

Figure 4:
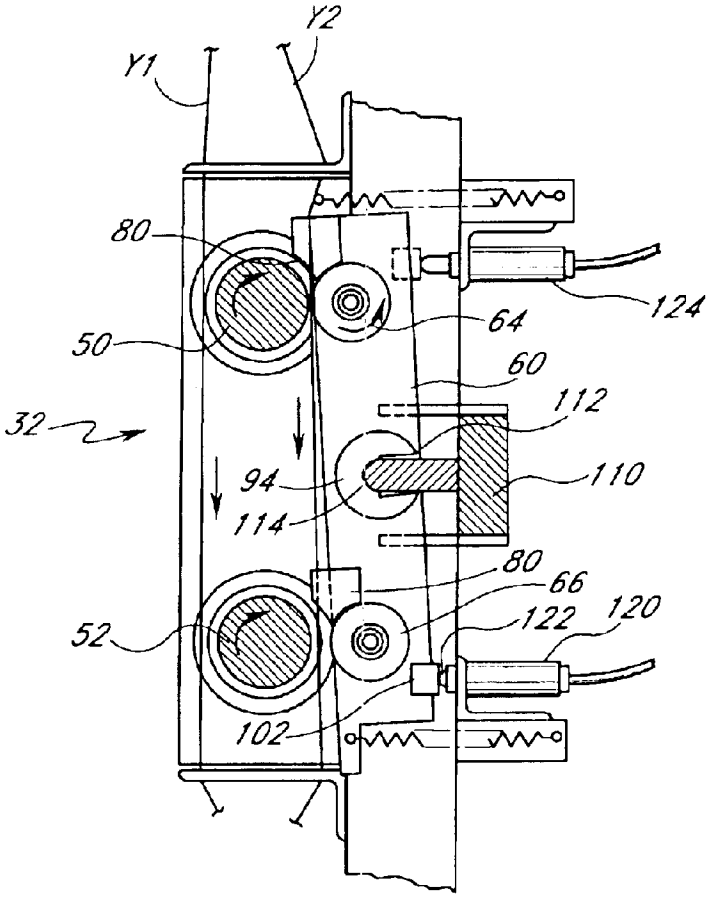
FIG. 4 (PRIOR ART)
FIG. 4 is an elevational view of the pitman arm and roller assembly shown in FIG. 3 with the pitman arm pivoted in a second position with the upper yarn wheel pressed against the upper yarn feed roller.
Figure 3:
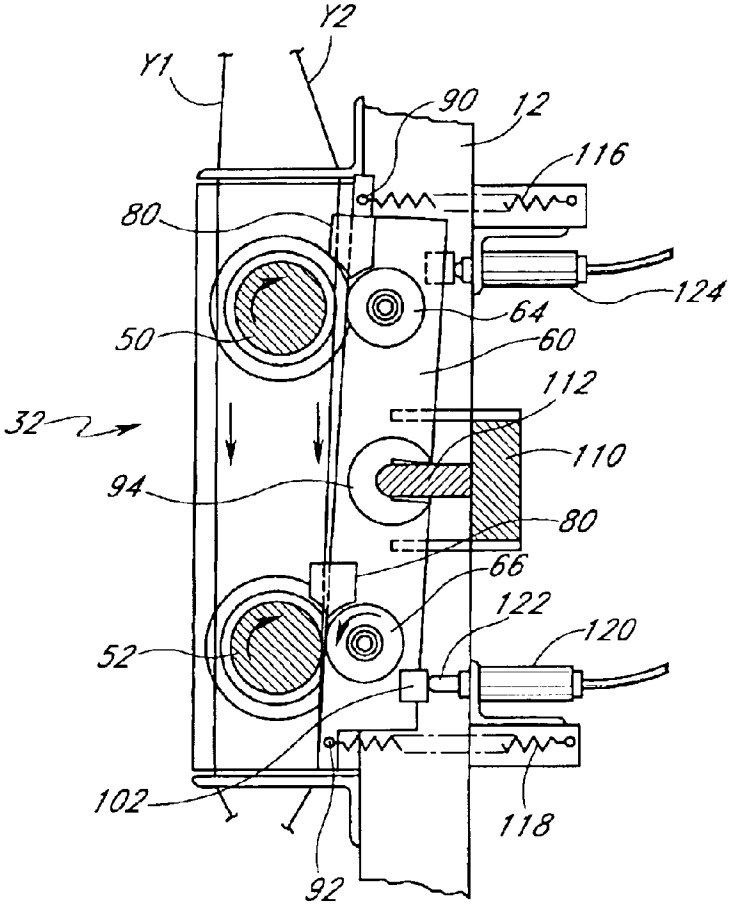
FIG. 3 (PRIOR ART)
FIG. 3 is an enlarged elevational view of the pitman arm illustrated in FIG. 2 pivoted in the first position such that the lower yarn wheel presses a strand of yarn against the lower yarn feed roller.

With reference to FIGS. 3 and 4, an enlarged elevational view of the feed roller assembly 32 is provided. However, it is to be noted that the feed roller assembly 30 is constructed and operates in substantially the identical manner as the feed roller assembly 32. Thus, further detail on operation of the feed roller assembly 30 will not be provided.

As shown in FIGS. 3 and 4, the rail 110 includes a fulcrum member 112 which extends into the journal member 94. Advantageously, the fulcrum member 112 includes a convex terminal end 114 which has a shape complimentary to the concave portion 100 of the journal member 94. Additionally, the upper and lower surfaces 96, 98 are spaced at a distance greater than the thickness of the fulcrum member 94. Thus, as the arm 60 pivots about the convex end 114 of the fulcrum member 112, the spacing of the upper and lower surfaces 96, 98 is sufficiently large that the upper and lower surfaces 96, 98 do not contact the outer surfaces of the fulcrum member 112.

Springs 116, 118 are attached to the upper and lower pins 90, 92 of the arm 60. One end of each spring 116, 118 is attached to the pins 90, 92, respectively. The other ends of the springs 116, 118 are mounted relative to the frame assembly 12.

At least one actuator 120 is supported by the frame 12 in the vicinity of the abutment portion 102. The actuator 120 can be in the form of any type of actuator, including for example, but without limitation, pneumatic actuators, solenoid driven actuators, hydraulic actuators, piezoelectric actuators, and stepper motors. In the illustrated embodiment, the actuator 120 is a pneumatic actuator having a plunger 122 contacting the abutment portion 102. Another pneumatic cylinder 124 is mounted such that its plunger contacts the abutment portion of an arm adjacent to the arm 60.

The pneumatic cylinders 120, 124 are controlled in a known manner so as to pivot the arm 60. For example, when the pneumatic cylinder 120 is filled with air such the plunger 122 is extended, as shown in FIG. 3, the yarn wheel 66 presses the yarn strand Y1 against the roller 52, and thus the yarn wheel "engages" the outer covering. The arm strand is thereby pulled from the yarn supply at a speed corresponding to the rotational speed of the feed roller 52. Advantageously, the spring 118 is stronger than the spring 116. Thus, when the air is released from the pneumatic cylinder 120, the arm 60 pivots to the position shown in FIG. 4 such that the yarn wheel 64 presses the yarn strand Y1 against the feed roller 50.

In reference to FIG. 1, the machine 10 also includes a controller 130. The controller 130 can be in the form of any known controller which would be appropriate for controlling a large number of actuators. For example, a programmable logic controller (PLC) can be used. In the illustrated embodiment, where pneumatic cylinders 120, 124 are used as the actuators, the controller 130 also includes a high pressure air supply 132. The high pressure air supply 132 is connected to each of the pneumatic cylinders 120, 124 so that the cylinders, 120, 124 can be independently actuated. Thus, when a signal to provide a greater amount of yarn to the needle associated with the arm 60 is transmitted to the controller 130 from a pattern control (not shown) the controller 130 can trigger the air supply 132 to provide air to the pneumatic cylinder 120 and thereby press the yarn strand Y1 against the high speed roller 52. Thus, the yarn strand Y1 will feed at a higher speed to the needle assembly and thereby provide a higher pile. This type of yarn feeding apparatus is known as a "full repeat scroll" because the feeding rate of each yarn strand can be independently controlled.

The controller 130 can be of any conventional type, such as, for example, but without limitation, a hard-wired system, a dedicated processor and memory storing one or a plurality of control routines, or a general purpose processor and memory storing one or a plurality of control routines, or other devices.

After prolonged operation, the arms 58, 60 can become damaged. For example, the bearings 72, 74 can become damaged. When the bearings 72, 74 become damaged, the corresponding yarn wheel 64, 66 can become seized. Once one of the wheels 64, 66 are seized, yarn will not feed properly. Thus, the arms 58, 60 occasionally have to be replaced.

In order to replace the arms 58, 60, the rollers 46, 48 or the rollers 50, 52 must be moved so that the arms 58 or 60 can be accessed. Thus, the bearing supporting assemblies 54, 56 are hingedly supported relative to the frame 12. In particular brackets 140, 142 are hingedly engaged with a portion of the frame 12. Thus, the brackets 140, 142 hingedly support the bearing support assemblies 54, 56, respectively. Each of the bearing support assemblies 54, 56 are attached to the frame assembly with two other bolts (not shown). Thus, when it is desired to replace one of the arms 58 from the feed roller assembly 30, two bolts must be removed from each bearing support assembly 54 therein. In a machine having rollers 46, 48 with a length of four meters, divided into seven yarn bays, 16 bolts must be removed to allow the bearing support assemblies 54 to pivot relative to the frame 12. With the bearing support assembly 54 pivoted as such, a repairman can reach behind the rollers 46, 48, to remove and replace the arm 58.

Another repair that must be performed regularly is the replacement of the outer surface of the rollers 46, 48, 50, 52. For example, after prolonged use, the yarn strands Y1, Y2 can cut grooves in the soft outer covering of the rollers 46, 48, 50, 52. When the covering is damaged as such, the covering must be removed and then replaced.

The feed rollers of a full repeat scroll attachment are particularly vulnerable to this type of failure because these systems rely on wheel pressure against the roller to provide the necessary friction for pulling the yarn strands. In other tufting machine attachments which use only a single roller to feed a particular strand of yarn, the roller are provided with a larger diameter than that of the feed rollers 46, 48, and the strands of yarn are wrapped around a substantial portion of the roller to provide a large contact patch between the yarn and the roller. Thus, yarn wheels generally are not used to press the yarn into engagement with such feed rollers.

However, in full repeat scroll attachments, such as in the tufting machine 10, the yarn strands are guided along a path that is substantially tangential to the feed rollers. The yarn wheel presses the yarn strand against the roller, thereby generating a small contact patch. Thus, significant pressure is necessary to generate sufficient friction between the yarn strand and the roller. The pressure applied by the yarn wheel causes the outer covering of the feed rollers to be damaged quickly. For example, in one known machine, the outer covering of the feed rollers lasts only about two weeks of operation. After the covering is damaged, it must be replaced.

One known method for replacing the covering is to rotate the shafts 46, 48, 50, 52 and wind a new covering on in a helical fashion. This procedure causes, in one machine, a three-foot section of carpet to be produced with incorrect pile heights. Thus, this portion of carpet must be discarded. Furthermore, the roll of carpet being manufactured at this time will have an odd size and thus must be sold as a second.

Another component that must be replaced occasionally is the bearings supporting the rollers 46, 48, 50, 52. These bearings (not shown) supported by the bearing support assemblies 54, 56 are difficult to replace because the rollers 46, 48, 50, 52 are long and are of a uniform outer diameter. Thus, if a bearing in the middle of the shaft has failed, several bearings will have to be removed along with the outer covering, before the damaged bearing can be removed.

With reference to FIGS. 5–10, an improved bearing support and feed roller assembly is illustrated therein. The bearing support and feed roller assembly illustrated in these figures can be provided on the machine 10 illustrated in FIGS. 1–4. However, the assembly could also be provided on other tufting machines or other scroll attachments, having different configurations, different numbers of feed rollers, and having different types of supports for the yarn wheels. However, as an illustrative, but non-limiting example, the improved bearing support and feed roller assemblies are described below as being used with a machine 10' which can be the same as the machine 10 illustrated in FIGS. 1–4, except as noted below. Thus, in FIGS. 5–10, similar components will be identified with the same reference numerals, except that a "'" has been added thereto.

Figure 5:
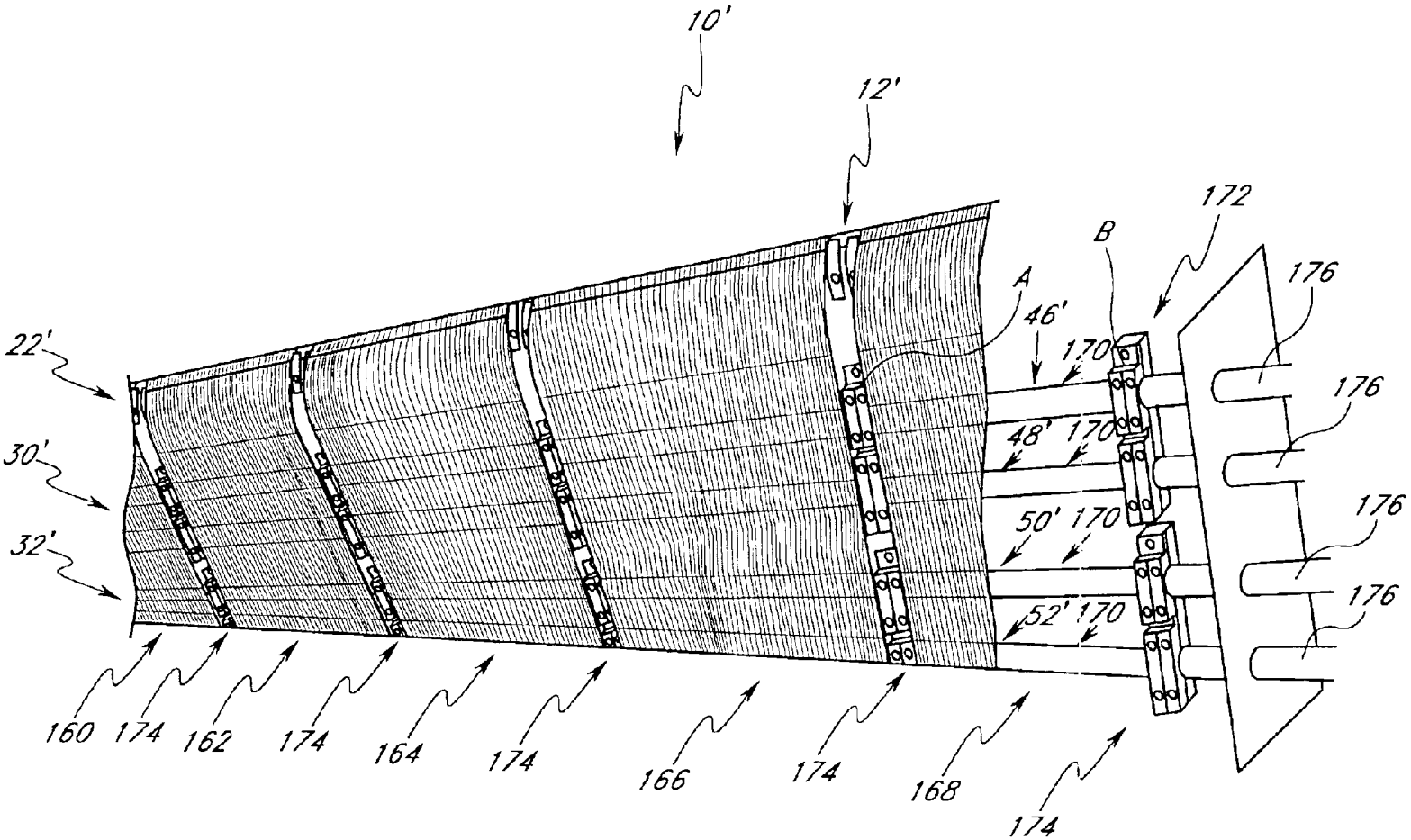
FIG. 5 is perspective view of a tufting machine including a feed roller and bearing support assembly construction in accordance with the present invention.

With reference to FIG. 5, the machine 10' includes upper and lower feed roller assemblies 30', 32'.

Although the machine 10' includes seven yarn bays, only five are illustrated and are identified by the reference numerals 160, 162, 164, 166, 168. The feed roller assemblies 30', 32' each include two feed roller assemblies 46', 48' and 50', 52', respectively.

Each of the feed roller assemblies 46', 48', 50', 52' comprise a plurality of coaxiallly aligned cylindrical members. In the illustrated embodiment, each of the cylindrical members comprises a feed roller shaft 170. Additionally, each feed roller assembly 46', 48', 50', 52', are supported by eight bearing support assemblies. Thus, the upper feed roller assembly 30' includes eight bearing support assemblies 172. The lower feed roller assembly 32' includes eight bearing support assemblies 174. In the illustrated embodiment, the bearing support assemblies 172, 174 can be identical.

Advantageously, each of the shafts 170 include terminal ends in the vicinity of the bearing support assemblies 172, 174. Thus, in the illustrated embodiment, each shaft 170 is substantially only as long as each bay 160, 162, 164, 166, 168.

The feed roller assemblies 30', 32' also include driveshafts 176 which extend beyond the last yarn bay 168. The driveshafts 176 are connected to feed roller drives (not shown) which drive the roller assemblies 46', 50' at one speed, and drive the other roller assemblies 48', 52' at a different speed. Alternatively, the driveshafts 176 for the feed roller assemblies 48', 52', could extend from the other end of the machine 10'.

Figure 6:
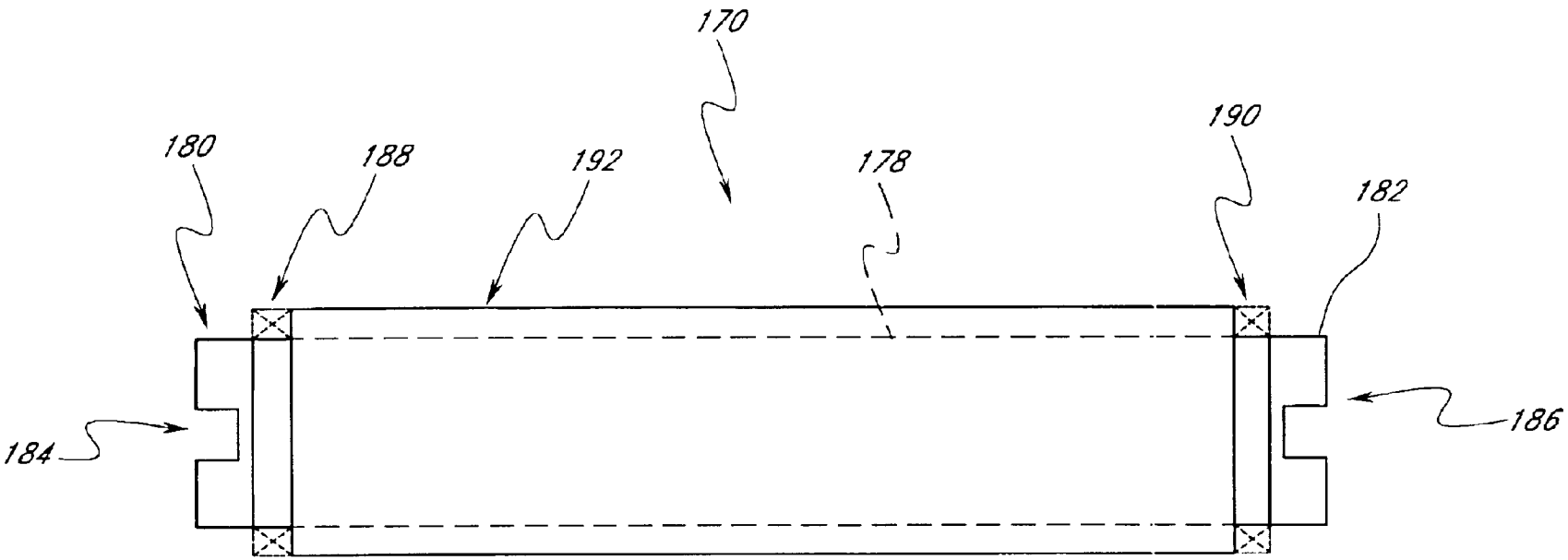
FIG. 6 is an elevational view of one of the roller shafts illustrated in FIG. 5.

With reference to FIG. 6, each feed roller shaft 170 includes a central elongate cylinder member 178. The terminal ends 180, 182 of the central member 178 have a reduced diameter relative to the central portion of the member 178. Each terminal end 180, 182 includes a slot 184, 186, respectively. Adjacent to each of the terminal ends 180, 182, a roller bearing 188, 190 is press fit onto the central member 178. The reduced diameter of the terminal ends 180, 182 makes it easier to fit the lower bearings 188, 190 over the terminal ends 180, 182.

The portion of the central member 178 between the roller bearings 188, 190 includes an outer covering 192, which is configured to provide traction with the yarn strands Y1, Y2. Preferably, the outer covering 192 is made from a vulcanized polymer. A presently preferred covering 192 is polyurethane that is vulcanized to the central member 178. Such a polyurethane is available in a variety of widths, or can be suit to a desired width. Presently, the polyurethane is wound around the central member 178 in a plurality of layers and then heated to vulcanize the layers together and to the central member 178. After vulcanization. the vulcainzed polyurethane is preferably ground to provide a more uniform outer surface. As such, the covering 192 can be provided with a surface that is smoother than that of the prior art, helically-wound, outer coverings.

Figure 7:
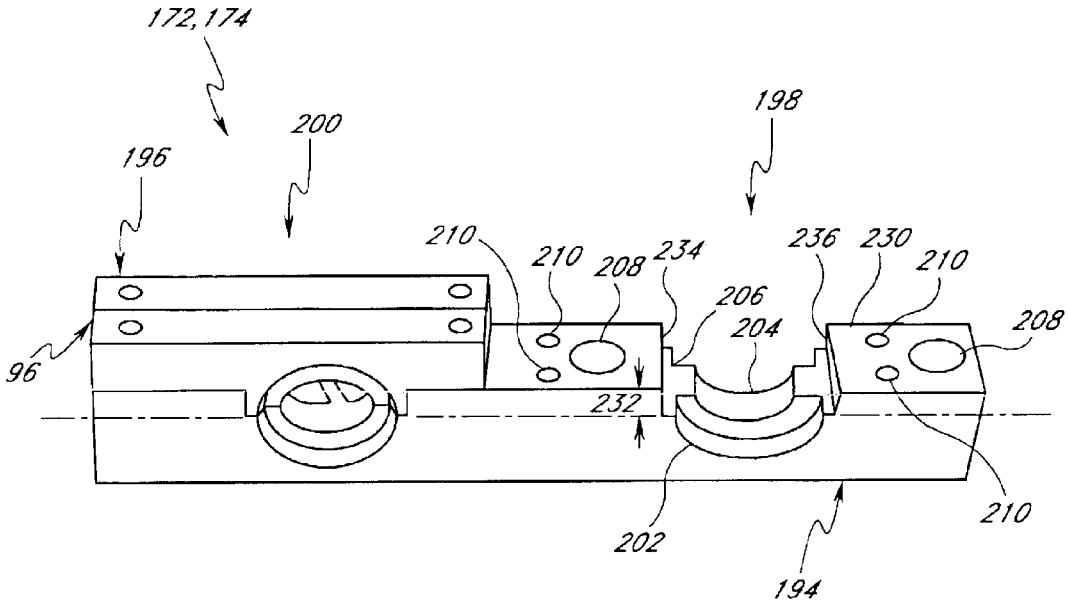
FIG. 7 is an enlarged perspective view of a portion of a bearing support assembly illustrated in FIG. 5, the right side portion of the illustrated bearing support assembly, as vied in the figure, having two cap members removed.

With reference to FIG. 7, the bearing support assemblies 172, 174 each include a base member 194 and four cap members 196, only two of the cap members 196 being shown in FIG. 7. The base member 194 includes two recessed portions 198, 200. The shape of the recessed portions 198, 200 are substantially identical. Thus, only the recessed portion 198 is described in detail below.

The recessed portion 198 includes three semi-circular concave surfaces 202, 204, 206. The concave surfaces 202, 206 are sized to receive the outer surfaces of the bearings disposed on terminal ends of a shaft 170, e.g., bearings 190 or 188. The concave surface 204 is sized to be more than twice as long as the terminal end 180, 182 of the shaft 170 having a reduced diameter.

The base member 194 also includes at least one mounting hole 208 for mounting the base member 194 to the frame 12' of the machine 10'. However, the base member 194 could have any number of mounting holes. Preferably, the base member 194 includes at least three mounting holes 208. Additionally, the base member 194 includes at least eight mounting holes 210 for securing the cap members 196 thereto, described in greater detail below.

Figure 8:
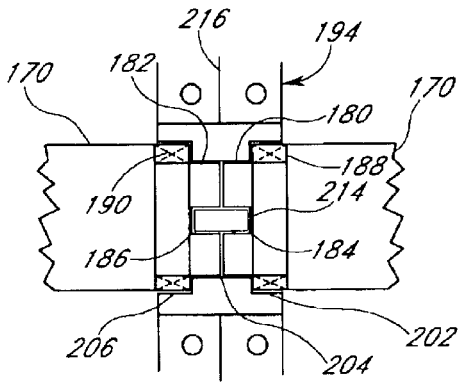
FIG. 8 is a top plan view of the terminal ends of two of the shafts illustrated in FIG. 6 having bearings near their terminal ends and having a key extending between the terminal ends of the shafts, the bearings and the terminal ends of the shaft being received and recesses formed in the bearing support illustrated in FIG. 6.

With reference to FIG. 8, the base members 194 can receive the terminal ends of two shafts 170. For example, as shown in FIG. 8, the concave surfaces 206 and 202 can receive the roller bearings 188, 190 of two adjacent shafts 170. As noted above, the concave surface 204 is preferably twice as wide as the terminal ends 182, 180 of adjacent shafts 170. Thus, with the bearings 188, 190 received in the surfaces 202, 206, the terminal ends 180, 182 can both be received in the concave surface 204 with a small clearance remaining between the terminal ends 180, 182.

Advantageously, a key 214 is received within the slots 184, 186 when the bearings 188, 190 are received in the concave surfaces 202, 206. Thus, rotational energy can be transferred between the shafts 170 through the key 214.

Preferably, the key 214 is sized so as to form an interference fit with both of the slots 184, 186. The key 214 can be made from any suitable material. A presently preferred key 214 is made from a phenolic composite material. Constructing the key 214 from a phenolic provides an additional advantage in that phenolic materials can be configured to be slightly more elastic than metal. Thus, a tighter interference fit can be achieved where the key is made from a phenolic rather than metal. For purposes of illustration, a center line 216 of the base member 194 passes through the gap between the terminal ends 180, 182 and through the key 214, in the plan view illustrated in FIG. 8.

Figure 9:
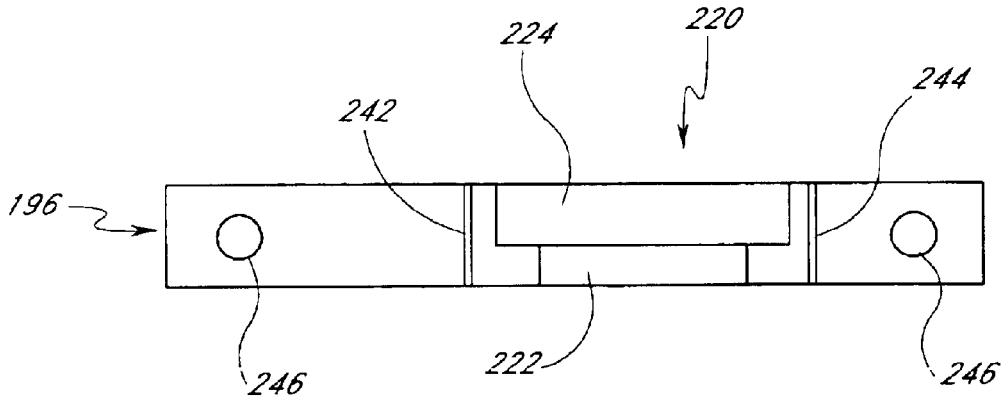
FIG. 9 is a bottom plan view of one of the cap members illustrated in FIG. 7.
Figure 10:
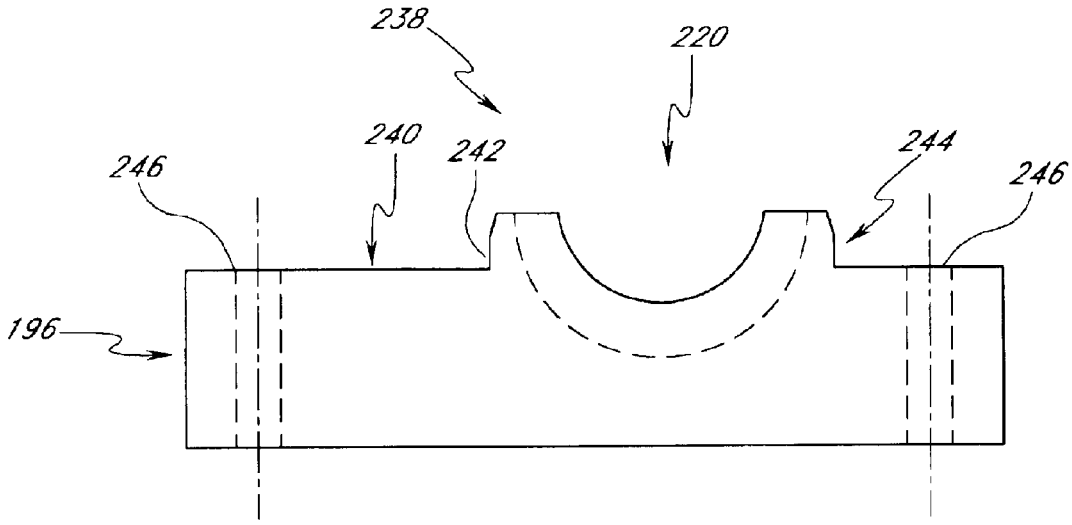
FIG. 10 is a side elevational view of the cap member illustrated in FIG. 9.

With reference to FIGS. 9 and 10, the caps 196 are configured to cooperate with the base member so as to enclose the bearings 188, 190 and the terminal ends 180, 182. Thus, the cap members 196 each include a recessed portion 220 that is configured to overlap with half of the recess 198. In particular, the cap 196 includes two concave surfaces 222, 224. The concave surface 224 is substantially identical to a concave surface 202 of the base member 194 in terms of its diameter. Although the concave surface 222 has the same diameter as the concave surface 204, the surface 222 is only half as wide as the surface 204. Thus, using two cap members such as the cap member 196 and a second cap member that is a mirror image (relative to the center line 216) of the cap member 196 the two shaft ends received in the base member 194 illustrated in FIG. 8 can be covered and thus securely journaled for rotation.

With reference to FIG. 7, advantageously, the recessed surfaces 202, 204, 206 are recessed from an upper surface 230 of the base 194. As shown in FIG. 7, the concave surfaces 202, 204, 206 are recessed inwardly from the upper surface 230 by a distance identified by the reference numeral 232. This recess forms side walls to 234, 236.

With reference to FIG. 10, the recessed portion 220 in the cap member 196 preferably is formed, at least partially, in a projection 238 of a lower surface 240 of the cap member. The projection 238 defines side walls 242, 244. Thus, when the cap member 196 is installed to the base 194, the projection 238 is received within the recess defined by side walls 234, 236. This cooperation provides for easier installation of the cap members 196 and insures proper alignment therewith. The cap members 196 also preferably include bolt holes 246 which are configured to align with holes 210 in the base member 194.

With reference to FIG. 5, if a pivot arm 58' in bay 168 fails, the shafts 170 corresponding to the portions of the feed roller assemblies 46', 48' in bay 168 can be removed without removing the other shafts 170 which form the remaining portions of the feed roller assemblies 46', 48'. For example, in order to remove the shaft 170 in bay 168 of feed roller assembly 46', the cap members 196 identified by the letters A and B can be removed by removing the four bolts which hold these cap members to the base members 194. Once the cap members A and B are removed, the shaft 170 can be pulled outwardly and removed from machine 10'. With a single piece of the feed roller assembly 46' removed, the damaged arm 58 can be removed and replaced. Additionally, if the outer covering of the shaft 170 is damaged, the shaft 170 can be removed and replaced without having to drive or "jog" the machine 10'. Thus, there is no need to cut the carpet currently being produced by the machine 10' and thus an odd size roll is not produced. Finally, if one of the bearings on the shaft 170 were damaged, they could be removed and replaced without having to remove the entire feed roller assembly 46'.

What is claimed is:

1. A tufting machine comprising a frame assembly, a plurality of parallel yarn feeding bays supported by the frame, an inlet yarn guide supported by the frame and configured to guide a plurality of yarn strands into each of the bays, a needle assembly supported by the frame and configured to reciprocate relative to the frame, an outlet yarn guide configured to guide the yarn strands from the bays into the needle assembly, first and second feed roller assemblies, each extending across all of the bays, at least first and second bearing assemblies supporting both of the first and second feed roller assemblies, each of the first and second bearing assemblies being disposed between two of the bays, first and second drives configured to drive the first and second feed roller assemblies, respectively, such that the first feed roller assembly is driven at a speed greater than a speed of the second feed roller assembly, at least first and second wheels mounted adjacent the first and second shafts, respectively, the first and second wheels being moveable between first and second configurations in which the first wheel presses a first yarn strand against the first feed roller in the first configuration, and in which the second wheel presses the first yam strand against the second feed roller when the rocker arm is in the second configuration, wherein each roller assembly comprises at least first and second coaxially aligned cylindrical members, each having a terminal end disposed in the vicinity of one of the bearing assemblies which are disposed between two bays, wherein the bearing assemblies are comprised of a base member having first, second, and third recesses, the second recess being disposed between the first and third recesses, wherein the first and second recesses are configured to support first and second bearings, respectively, the first and second bearing being disposed on the first and second cylindrical members, respectively.

2. The tufting machine according to claim 1, wherein the first and second recesses are spaced such that the terminal ends of the first and second cylindrical members are spaced from each other when the first and second bearings are disposed in the first and second recesses, respectively.

3. The tufting machine according to claim 2, wherein each of the terminal ends include slots.

4. The tufting machine according to claim 3 additionally comprising a key sized so as to extend into both of the slots.

5. The tufting machine according to claim 4, wherein the second cylindrical member is rotated by the first cylindrical member, all of the torque transferred from the first cylindrical member to the second cylindrical member passing through the key.

6. The tufting machine according to claim 4, wherein the third recess is sized to receive the portions of the terminal ends including the slots and the key.

7. The tufting machine according to claim 2, wherein the bearing assemblies further comprise at least first and second cap members, the first cap member being configured to overlie the first recess and at least a portion of the second recess, the second cap member being configured to overlie the third recess and at least a portion of the second recess.

8. The tufting machine according to claim 7, wherein the first and second cap members are sized such that when the first cap member is placed to overlie the first bearing received in the first recess, the second bearing be placed into and removed from the second recess without removal of the first cap member.

9. A tufting machine comprising at least two parallel yarn feeding bays, at least one bearing support assembly disposed between the bays, at least one feed roller assembly extending across the bays, a plurality of wheels each being moveable into and out of engagement with the feed roller assembly, the feed roller assembly comprising a plurality of co-axially aligned rollers being separable at a position in the vicinity of the bearing support assembly, wherein the bearing support assemblies are comprised of a base member having first, second, and third recesses, the second recess being disposed between the first and third recesses, wherein the first and second recesses are configured to support first and second bearings, respectively, the first and second bearing being disposed on first and second of the plurality of rollers, respectively.

10. The tufting machine according to claim 9, wherein the first and second recesses are spaced such that terminal ends of the first and second rollers are spaced from each other when the first and second bearings are disposed in the first and second recesses, respectively.

11. The tufting machine according to claim 10, wherein each end of each roller includes a slot.

12. The tufting machine according to claim 11, additionally comprising a key sized so as to extend into two of the slots.

13. The tufting machine according to claim 12, wherein the first roller rotates the second roller, wherein all of the torque transferred therebetween passes through the key.

14. The tufting machine according to claim 13, wherein the third recess is sized to receive the portions of the terminal ends including the slots and the key.

15. The tufting machine according to claim 9, wherein the bearing assemblies further comprise at least first and second cap members, the first cap member being configured to overlie the first recess and at least a portion of the second recess, the second cap member being configured to overlie the third recess and at least a portion of the second recess.

16. The tufting machine according to claim 15, first and second cap members are sized such that when the first cap member is placed to overlie the first bearing received in the first recess, the second bearing be placed into and removed from the second recess without removal of the first cap member.

* * * * *

UNITED STATES PATENT AND TRADEMARK OFFICE

CERTIFICATE OF CORRECTION

PATENT NO. : 6,758,154 B2
DATED : July 6, 2004
INVENTOR(S) : Kendall Johnston

It is certified that error appears in the above-identified patent and that said Letters Patent is hereby corrected as shown below:

Column 1,
Line 50, change “an” to -- a --.

Column 4,
Line 14, change “vied” to -- viewed --.

Column 7,
Line 14, change “arm” to -- yarn --.

Column 9,
Line 12, change “are” to -- is --.

Column 11,
Line 48, change “yam” to -- yarn --.
Line 57, change “second” (first occurrence) to -- third --.
Line 65, change “second” to -- third --.

Column 12,
Lines 21, 42 and 64, change “second” to -- third --.
Line 34, change “second” (first occurrence) to -- third --.

Signed and Sealed this

Twenty-first Day of March, 2006

JON W. DUDAS
*Director of the United States Patent and Trademark Office*